US005161732A

United States Patent [19]

Clein et al.

[11] Patent Number: 5,161,732

[45] Date of Patent: Nov. 10, 1992

[54] FOLD-OUT CARTON AND BLANK THEREFOR

[75] Inventors: Allen W. Clein, Scarborough; Warren J. Clein, Unionville; Bruce D. Clein, North York, all of Canada

[73] Assignee: Accurate Rolal Co. Limited, Ontario, Canada

[21] Appl. No.: 693,954

[22] Filed: Apr. 29, 1991

[51] Int. Cl.[5] ..... B65D 71/70

[52] U.S. Cl. ..... 229/117; 206/170; 206/180; 229/185

[58] Field of Search ..... 206/162, 167, 185, 188, 206/193, 198, 427, 170, 180; 229/117, 185

[56] References Cited

U.S. PATENT DOCUMENTS

| | | | |
|---|---|---|---|
| 2,659,526 | 11/1953 | Buttery | 229/117 |
| 2,677,495 | 5/1954 | Buttery | 229/117 |
| 2,760,709 | 8/1956 | Bruehl et al. | 229/117 |
| 2,798,656 | 7/1957 | Kuchenbecker | 229/117 |
| 2,881,946 | 4/1959 | Bosrock et al. | 229/117 |
| 2,884,180 | 4/1959 | Inman | 229/117 |
| 2,943,780 | 7/1960 | Bolding | 229/117 |
| 3,057,535 | 10/1962 | Thompson | 229/117 |
| 4,312,446 | 1/1982 | Summers | 206/185 |
| 4,838,414 | 6/1989 | Blackman | 206/185 |

*Primary Examiner*—Jimmy G. Foster
*Attorney, Agent, or Firm*—Renner, Kenner, Greive, Bobak, Taylor & Weber

[57] ABSTRACT

A paperboard carton having an improved locking bottom. The disclosed carton has a collapsed position and an expanded position. In its expanded position, it has a square flat bottom which includes four flaps. A first pair of floor flaps, foldably attached along the bottom edges of opposite sidewalls have tabs which interlock when the carton is in the expanded position. The second pair of floor flaps, foldably attached along the bottom edges of the remaining opposite sidewalls, are relatively large and overlie the first pair of flaps and overlap each other when the carton is in the expanded position. Each of the first pair of floor flaps is divided into two sections by a foldline when extends from a corner of the expanded carton. For each such flap, there is a first section, adjacent one of the remaining pair of floor flaps and glued to its underside so that the floor flaps are sandwiched up between the sidewalls of the collapsed carton and such that when the carton is unfolded from its collapsed to expanded position, the floor flaps unfold synchronously. The interlocking tabs have edges located to abut each other as the flaps of the expanded carton are forced out of their flat position. The abutment thus tends to hold the carton floor and sidewalls in the expanded position. The floor flaps are shaped to ensure that as the carton is unfolded each non-interlocking floor flap unfolds to overlie the neighboring flap to which it is not glued. The carton sidewalls also have upper portions defined above horziontal cuts in the sidewalls, which portions fold inwardly from corners of the carton towards the center of the carton to form upwardly open bottle receiving compartments. Apertures in the upper portions provide handles for carrying the carton.

8 Claims, 8 Drawing Sheets

FOLD-OUT CARTON AND BLANK THEREFOR

FIELD OF THE INVENTION

This invention relates to cartons or boxes of material such as paperboard and to blanks for such cartons. In particular this invention relates to a carton having four sidewalls and an improved bottom. The carton has a collapsed position for shipping and an expanded position for holding items such as bottles. Floor flaps hold the carton open when the carton is in its expanded position.

BACKGROUND OF THE INVENTION

Paperboard cartons for carrying beverage bottles must meet a number of criteria. They must be inexpensive to make and ship, easy to use, attractive and strong.

It is an advantage to be able to stamp a carton blank in a single operation. It is also helpful to be able to fold and glue the blank to make an assembled carton using a highly automated process.

A carton should be made from inexpensive material. It is preferable that only one side of the material from which the carton is manufactured require printing. Stock material finished on one side is less expensive than that finished on both sides, and it is cheaper to print on one side of the material only.

A carton should also use a small amount of raw material. It should be made from a relatively small blank, but use a high percentage of the stock material from which it is stamped.

In order to reduce shipping and storage costs, paperboard cartons have a collapsed position for storage and for shipment from the carton manufacturer to the bottler. It is preferrable that it be possible to fold a carton from its collapsed position to its expanded position easily and using automated equipment. The expanded carton is generally required to have open bottle receiving compartments for automated loading. The carton, once in its expanded position, should be resistant to collapse; it should stay open for bottle loading.

The carton often needs a handle, especially if it is used for carrying bottles.

It is important, within the constraints imposed by economy, that a carton be strong. Bottles are stored by the distributor and retailer in cartons, and may be returned to a retailer for deposit in the original carton as well. Cartons often get wet, which can reduce the strength of paperboard.

A rectangular, collapsible box is known for the storage of screws and bolts. The blank for this box is shown and described in more detail below. Neighboring pairs of four floor flaps are glued to each other and move synchronously as the box is moved between its expanded and collapsed positions. The floor flaps fold up into the box when in its collapsed position so as to be sandwiched between side wall panels of the box. The floor flaps are shaped so that when the box is folded out from the collapsed to its expanded position, two of the flaps attached to opposite side wall panels overlie the remaining pair of floor flaps. Unfortunately, the box has a tendency to fold back into its collapsed position when empty. The presence of box contents pressing down on the box floor to maintain a flat lying position reduces this tendency. The box also has top flaps, which when folded and fastened in place hold the box in its expanded position. The two overlying floor flaps may be dimensioned to largely cover the floor area of the box so that downwardly acting forces are distributed over the box floor, lending a resilience against deformation of the box shape from such forces due to box contents.

There is also known a bottle carton having a square bottom and divided into four bottle receiving compartments by upper dividers folded in from the corners of side wall panels. The blank for this carton is also shown and described in more detail below. There are four bottom flaps, neighboring pairs of which are glued together and arranged to be folded up into the carton when in its collapsed position so as to be sandwiched between side wall panels of the carton. Two of the flaps are shaped to have edges which abut when the carton is in its expanded position. This abutment helps to hold the carton when empty from folding back up into its collapsed position. Each floor flap partially overlaps one of its neighbors. This fan-like arrangement of floor flaps does not permit a pair of opposite floor flaps to be dimensioned to largely cover the floor area of the carton for distribution of downwardly acting forces, and so the bottom of this carton tends to lack strength.

BRIEF SUMMARY OF THE INVENTION

The present invention provides a carton and a blank for a carton having a floor bottom in which floor flaps attached to opposed side wall panels overlie the remaining two floor flaps which in turn provide tabs which abut to hold the carton in its expanded position in the absence of carton contents. It is thus possible, with the present invention, to obtain a carton or box having a pair of relatively large flaps which cover the remaining pair of flaps to distribute downwardly acting forces. The underlying flaps have a pair of abutting edges to hold the carton in its expanded position.

The disclosed embodiment provides a carton having open bottle-receiving compartments and a pair of handle portions formed from inwardly folded portions of side wall panels of the carton, which portions are located along center lines of the carton.

DETAILED DESCRIPTION OF THE DRAWINGS

Prior Art

Figure 1:
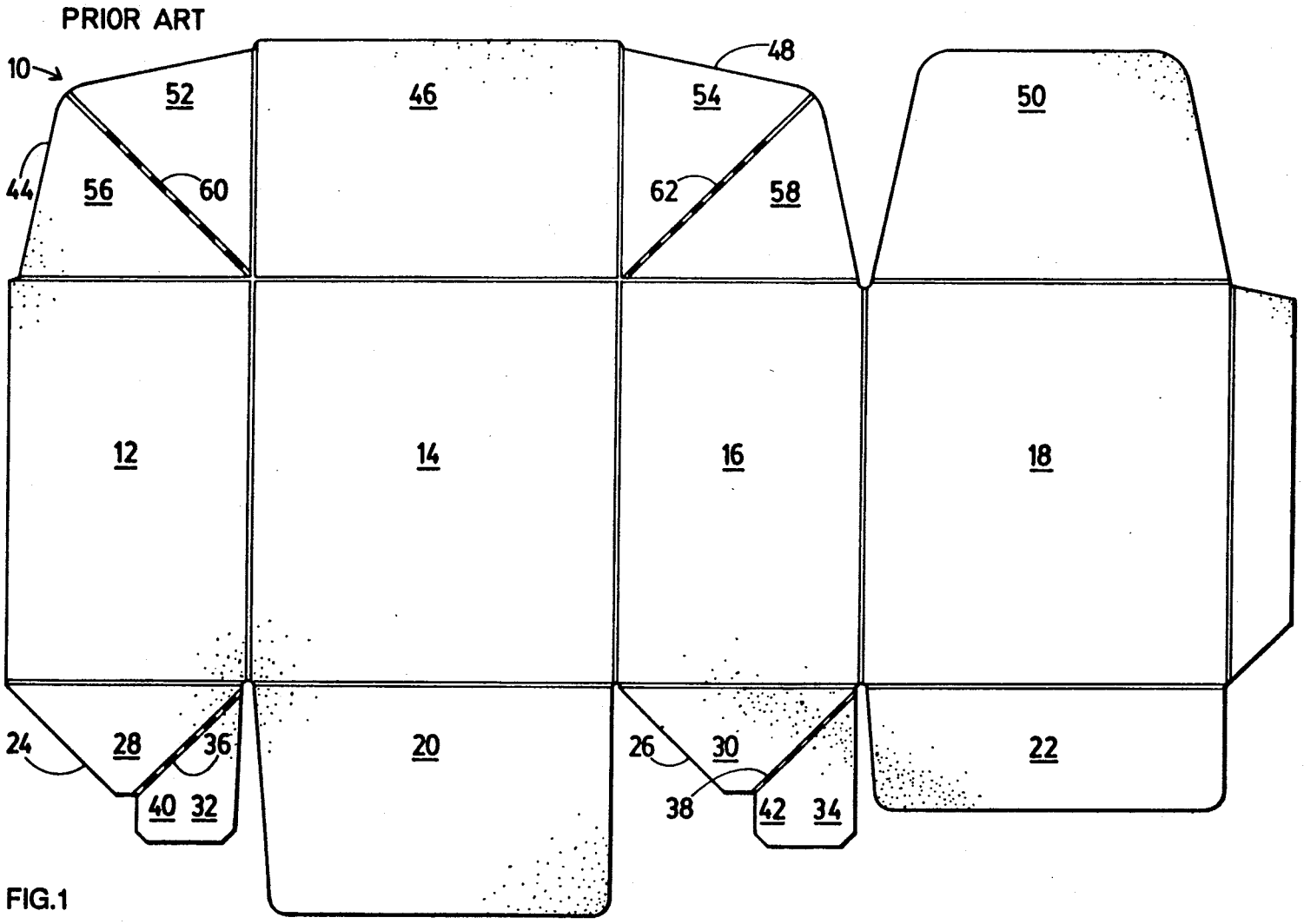
FIG. 1 is a blank of a prior art box.

There is a known box, commonly used for the storage of screws and bolts, a blank 10 for which is shown in FIG. 1. Blank 10 has four side wall panels 12, 14, 16, 18. There are rectangular bottom flaps 20, 22 foldably attached to the lower edges of alternate side panels 14, 18 which are opposed when the blank is assembled and in an expanded position. Remaining bottom flaps 24, 26 have first triangular sections 28, 30 and second trapezoidal sections 32, 34 foldably attached to the first sections along perforated foldlines 36, 38. When assembled, the inner sides 40, 42 of trapezoidal sections are adhered to the outer sides (opposite to those shown in FIG. 1) of neighboring rectangular flaps such that when the box is in its expanded position and the bottom flaps lie flat neighboring side wall panels are orthogonal to each other. There are top flaps 44, 46, 48, 50 foldably attached along the upper edges of the side panels. Rectangular top flap 46 is also foldably attached to neighboring top flaps 44, 48. The neighboring top flaps are divided into first triangular sections 52, 54 and second triangular sections 56, 58 by perforated bisector foldlines 60, 62, respectively. A box assembled from blank 10 has a collapsed position in which the bottom flaps are sandwiched up between the side panels and smaller bottom flaps 24, 26 are folded along foldlines 36, 38. In the expanded position of the box in which the bottom flaps lie flat to form a box bottom, larger bottom flap 20 overlies smaller bottom flap 22. The expanded rectilinear position of the box is maintained by the weight of box contents pressing down on the inside of the bottom flaps and by virtue of the adhesive connection of neighboring flaps 20, 24 and 22, 26 which fold and unfold synchronously. Alternatively, or in addition to using box contents, box shape may be maintained by folding of the top flaps down and fastening the box closed. The rectilinear shape of the box is maintained by virtue of the connection between flap 46 and neighboring flaps 44, 48.

Figure 2:
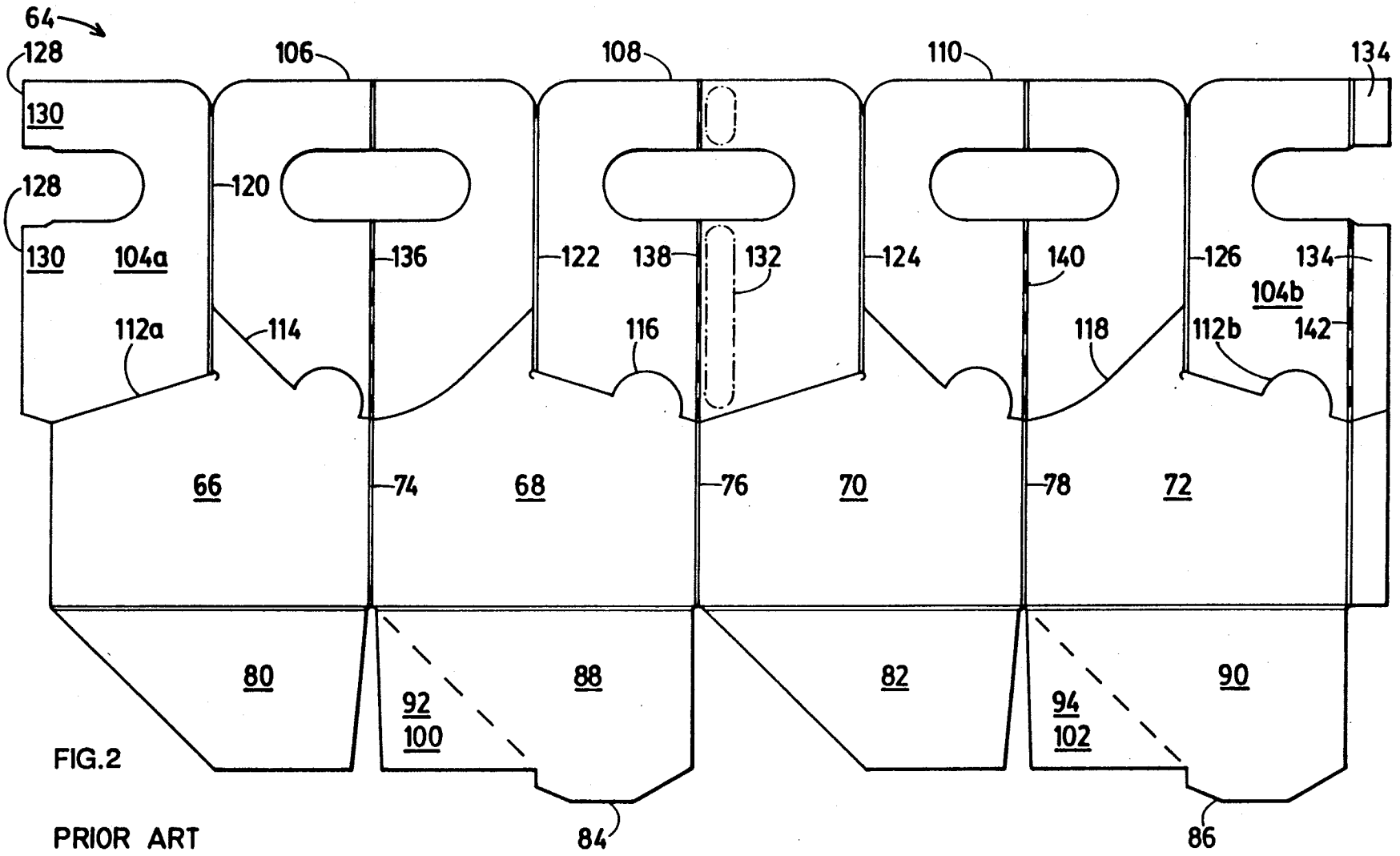
FIG.2 PRIOR ART
FIG. 2 is a blank of a prior art carton.

There is also a known carton having a square bottom and divided into four open compartments, generally used for carrying four bottles, a blank 64 for which is shown in FIG. 2. Blank 64 has four consecutively arranged side wall panels 66, 68, 70, 72 foldably attached along panel foldlines 74, 76, 78. There are bottom trapezoidal flaps 80, 82 foldably attached along the lower edges of alternate panels 66, 70, which panels are opposed when the blank is assembled and in an expanded position. Remaining bottom flaps 84, 86 have first irregular sections 88, 90 and triangular sections 92, 94 foldably attached to the irregular sections along perforated foldlines 96, 98. When assembled, the inner sides 100, 102 of the triangular sections are glued to the outer sides (opposite to those shown in FIG. 2) of neighboring trapezoidal flaps such that when the carton is in its expanded position and the bottom flaps lie flat parallel to each other, neighboring sidewall panels are orthogonal to each other. The blank also has upper panels 104*a*, 104*b*, 106, 108, 110 divided from the side wall panels by horizontal cutlines 112*a*, 112*b*, 114, 116, 118 and foldably attached by webs between ends of neighboring cutlines at vertical upper foldlines 120, 122, 124, 126. When assembled, the blank is folded along panel foldline 74 and upper panel tabs 128 are glued by interior sides 130 to the inner side of upper panel 108 in region 132. Side wall panel 72 is folded onto side wall panel 70 along panel foldline 78 and the inner side of panel tabs 134 are glued to the portions of outer sides of panels 66, 104*a* with which the tabs overlap. When the carton is in its expanded position, the upper panels are folded inwardly along foldlines 120, 122, 124, 126 such that upper portions of panel foldlines 136, 138, 140, 142 meet, i.e., are essentially colinear, above the center of the carton bottom. The carton is thus divided into four equal upwardly open compartments, when the carton is in its expanded position.

A Preferred Embodiment

Figure 3:
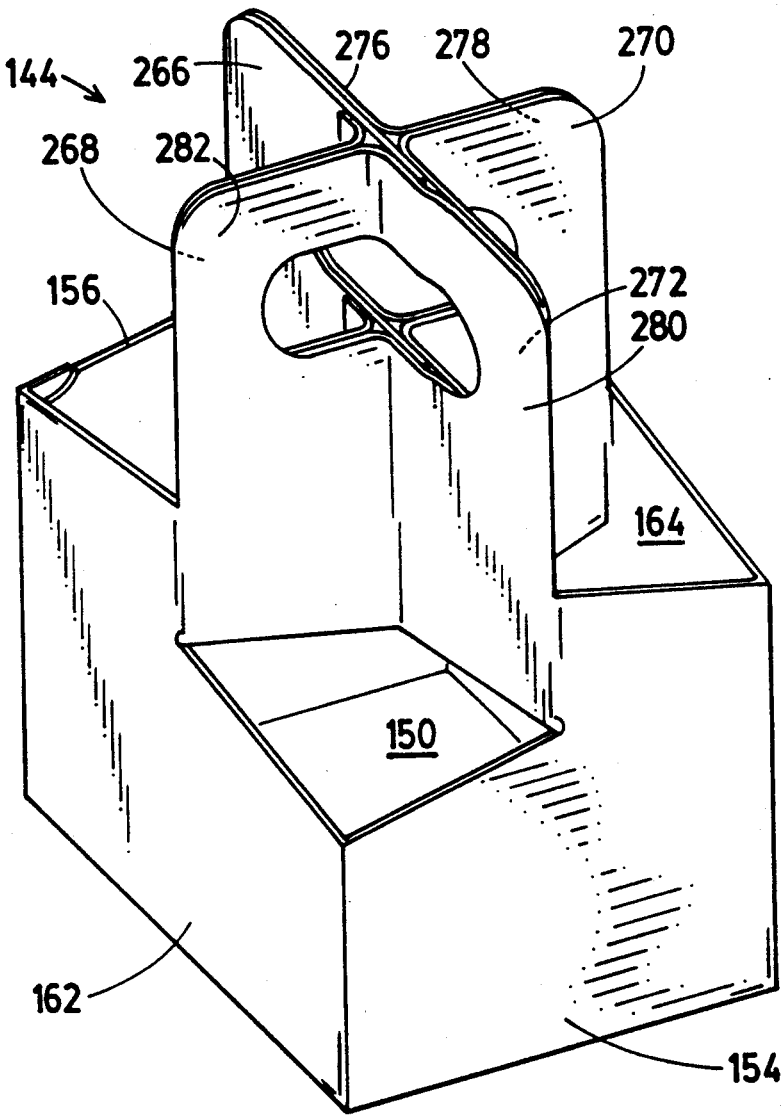
FIG. 3 is an isometric top and side view of the preferred embodiment carton, assembled and in an expanded position.
Figure 4:
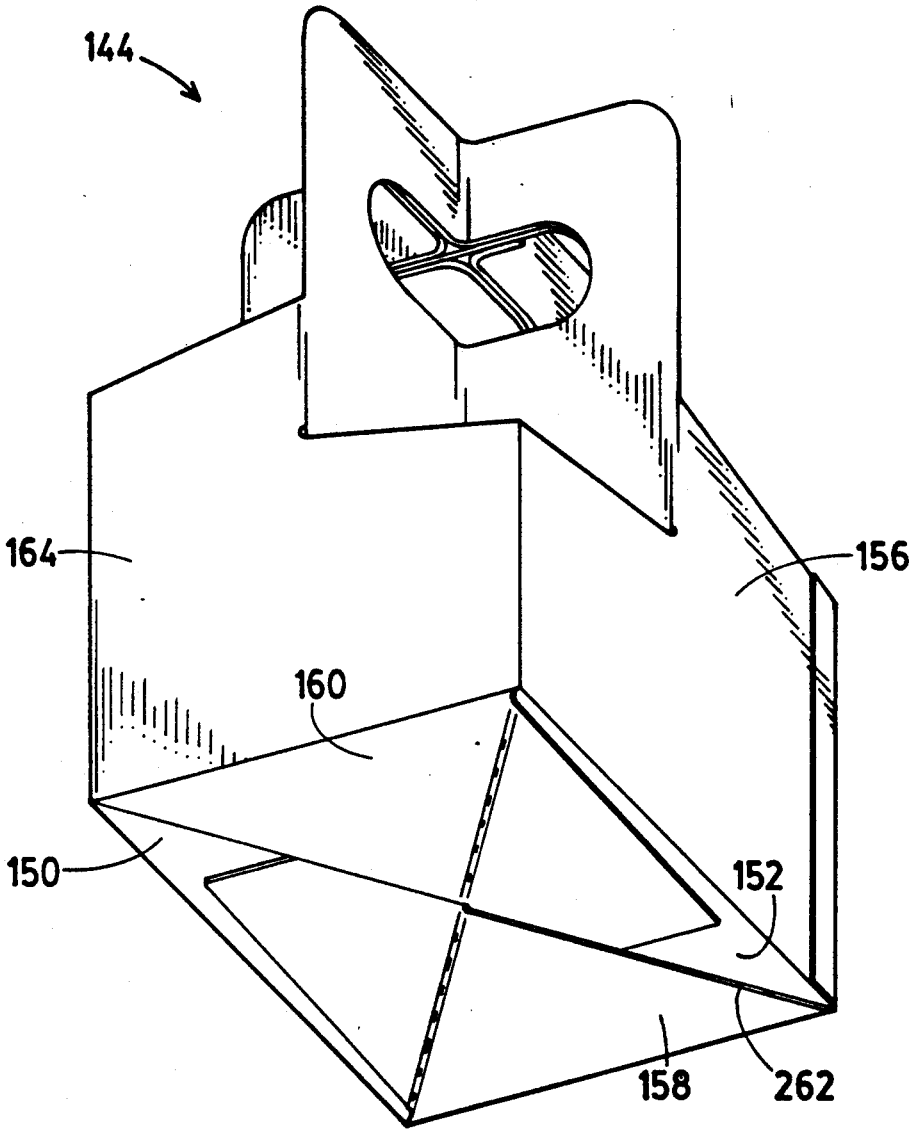
FIG. 4 is an isometric bottom and side view of the preferred embodiment carton, assembled and in an expanded position.
Figure 5:
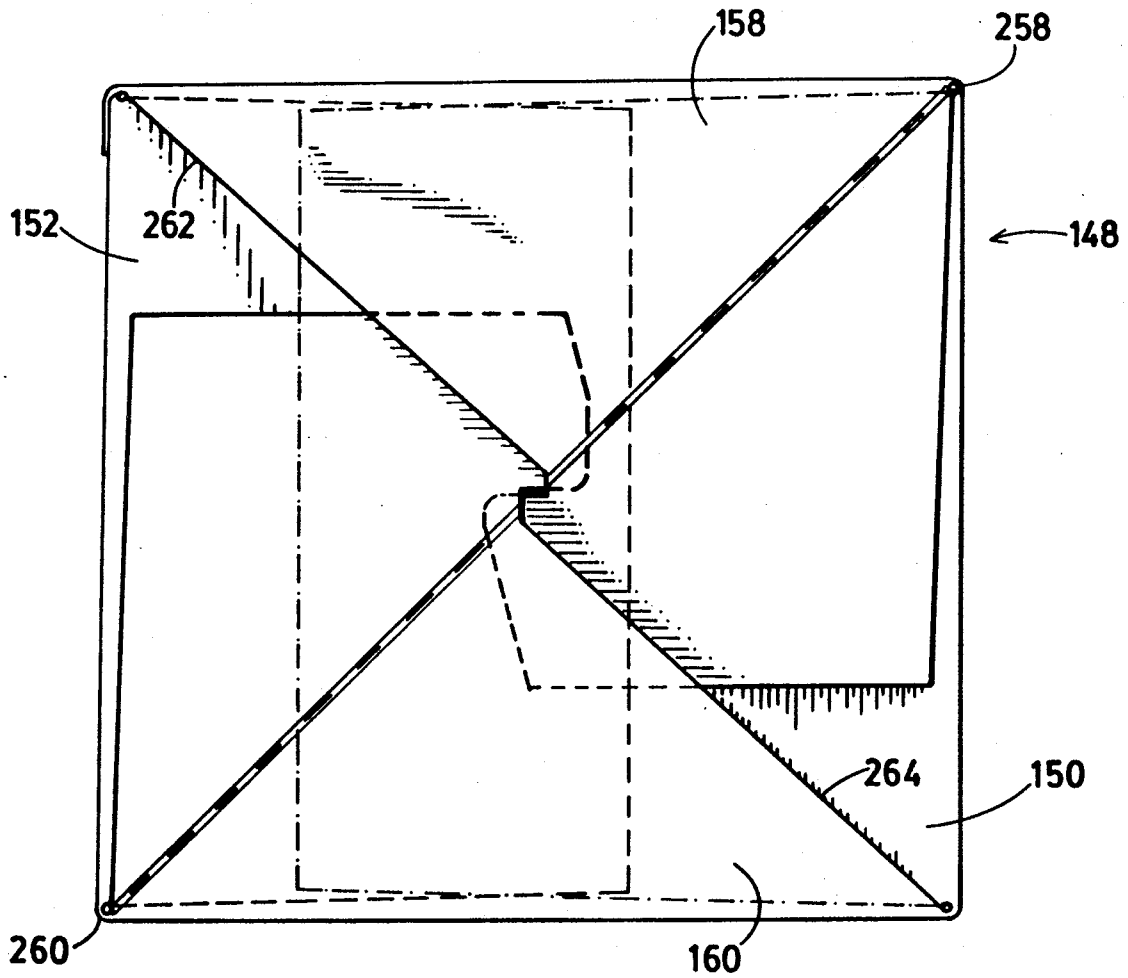
FIG. 5 is a plan view of the bottom of the preferred embodiment carton in the expanded position.
Figure 7:
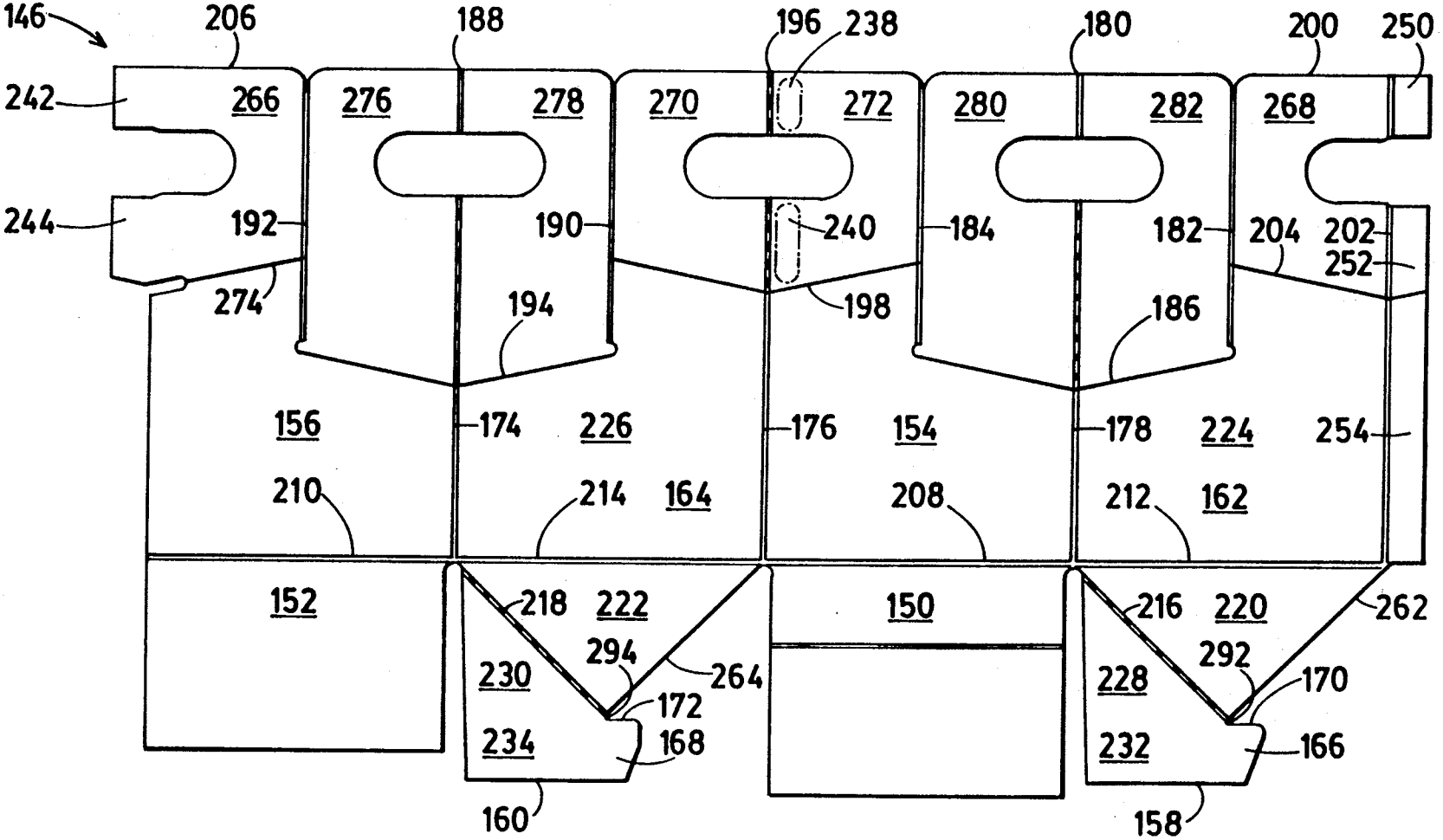
FIG. 7 is a plan view of a blank of the preferred embodiment carton showing inner surfaces of carton sides.
Figure 8:
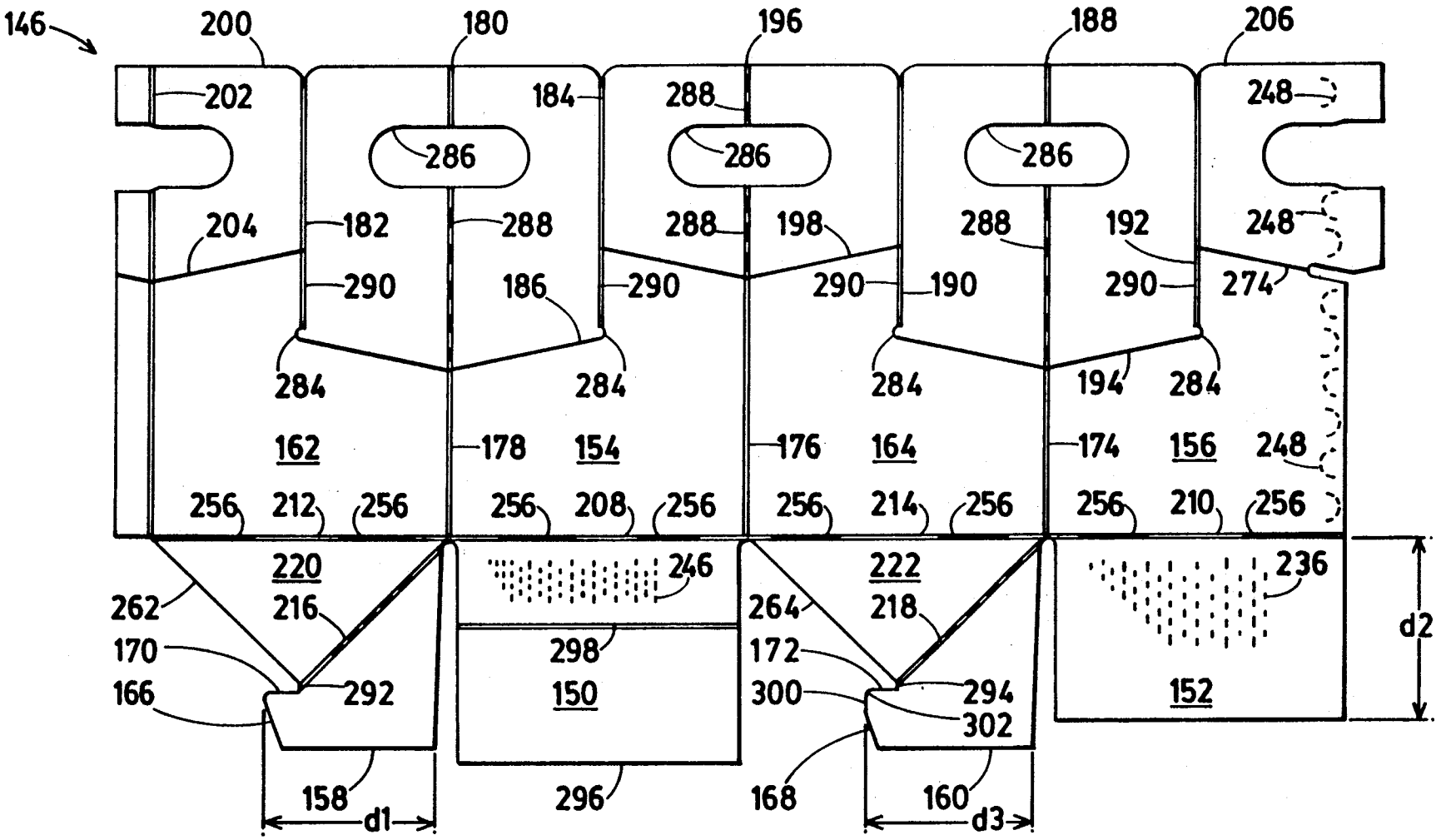
FIG. 8 is a plan view of a blank of the preferred embodiment carton showing outer surfaces of carton sides.

A preferred embodiment carton 144 is illustrated in its assembled expanded position in FIGS. 3, 4 and 5. The carton is shown in its assembled collapsed position in FIG. 6 while the inner and outer sides of a flat blank 146 from which the carton is formed are shown in FIGS. 7 and 8.

Bottom 148 includes two major flaps 150, 152 foldably attached to side wall panels 154, 156 while two minor flaps 158, 160 are foldably attached to side wall panels 162, 164. When the carton is in its expanded position, major flaps 150, 152 overlie minor flaps 158, 160 while minor flaps have tabs 166, 168 With edges 170, 172. In the flat blank 146, side wall panels 156, 164, 154, 162 are arranged consecutively, being foldably attached along panel foldlines 174, 176, 178, respectively.

Carton divider panel 180 is defined between upper foldlines 182, 184 and above cutline 186. Carton divider panel 188 is defined between upper foldlines 190, 192 and above cutline 194. Carton divider panel 196 is defined between upper foldlines 184, 190 and above cutline 198. Carton divider panel portion 200 is defined between upper foldline 182, and panel foldline 202 and above cutline 204 while carton divider panel portion 206 is defined, as viewed in FIG. 7, to the left of upper foldline 192 and above side wall panel 156.

Figure 6:
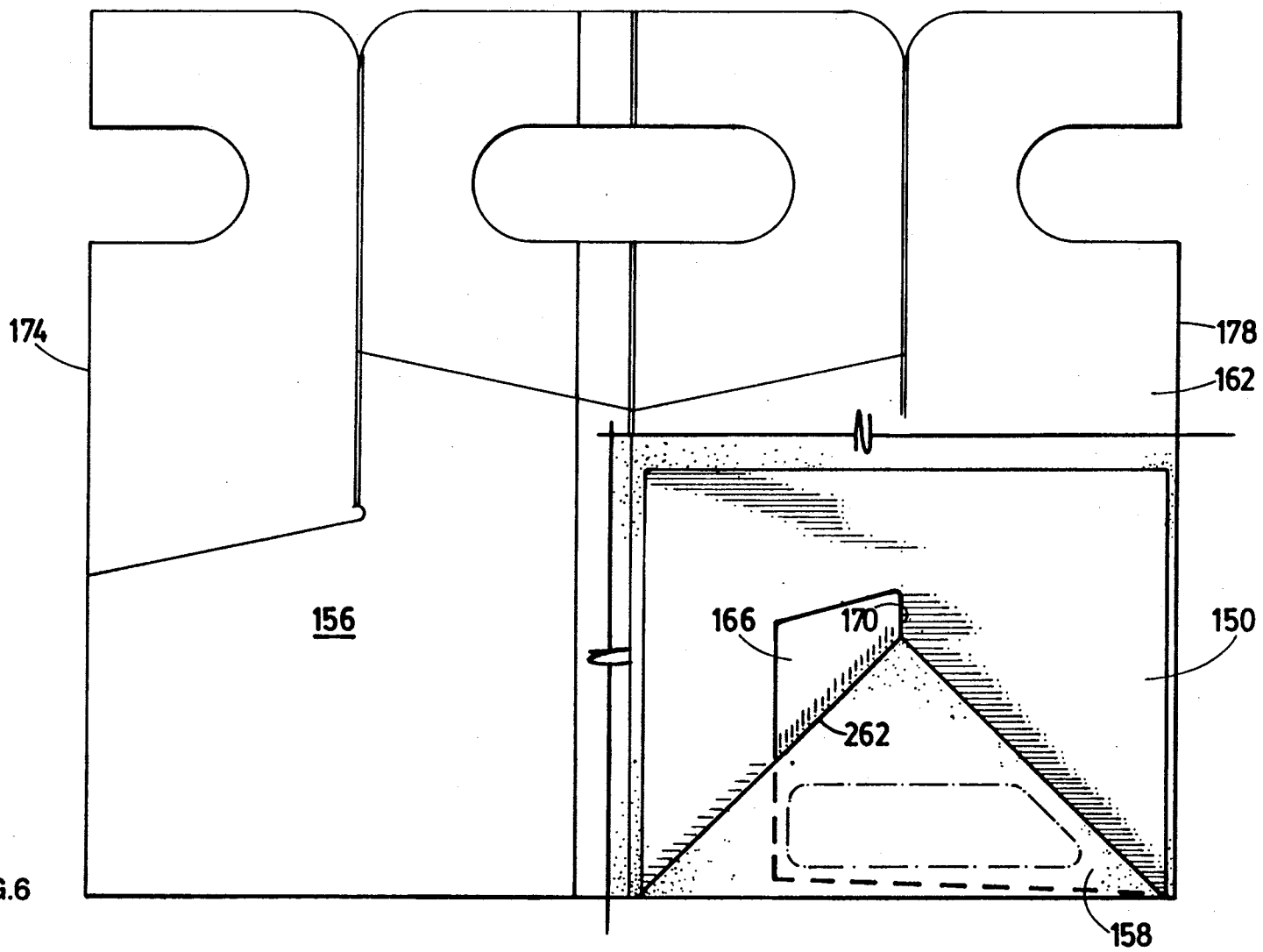
FIG. 6 is side view in elevation, partially cut away, of the preferred embodiment carton, assembled and in a collapsed position.

Blank 146 is stamped from a sheet of paperboard and assembled into the collapsed position shown in FIG. 6. With reference to FIG. 7, major flaps 150, 152 are folded onto side wall panels 154, 156 along panel-flap foldlines 208, 210 such that the inner surface of each flap faces the inner surface of the panel to which it is attached. Minor flaps 158, 160 are folded onto side wall panels 162, 164 along panel-flap foldlines 212, 214 located along bottom edges of the panels. The minor flaps are also folded along perforated bisector foldlines 216, 218 such that respective triangular sections 220, 222 face inner surface 224, 226 of panels 162, 164 to which they are attached and the remaining sections 228, 230 have their inner surfaces 232, 234 facing in the same direction as inner surfaces 224, 226. This latter arrangement is most easily seen in the cut-away portion of FIG. 6 for minor flap 158. Once the above folding arrangement is achieved, glue is applied to scored region 236 on the outer surface of flap 152 and on shaded regions 238, 240 of the inner surface of divider panel 196. The blank is then folded along panel foldline 174 in order to bond the outer surface i.e. obverse face of major flap 152 to the inner surface i.e. reverse face 234 of the neighboring section 230 of minor flap 160 and tabs 242, 244 to regions 238, 240. Glue is then applied to scored region 246 on the outer surface of flap 150 and scored region 248 running up the outer surfaces of wall panel 156 and carton divider panel portion 200. The blank is then folded along panel foldline 178 to bond region 246 and inner surface 232 of the neighboring section 228 of minor flap 158 and tabs 250, 252, 254 to scored region 248 to obtain the collapsed assembled carton shown in FIG. 6. The folding and gluing steps may be carried out by automated equipment. As seen in FIG. 6, major and minor flaps 150, 158 are sandwiched between side wall panels 154, 162 when the assembled carton is in the collapsed position while respective major and minor flaps 152, 160 are sandwiched between side wall panels 156, 164. Semi-perforations 256 on the outside of blank 146 which pierce its surface but do not extend through the blank material help to obtain a clean fold along panel-flap foldlines 208, 210, 212, 214.

The assembled collapsed carton may be folded out to its expanded position by inward compression along panel foldlines 174, 178. As the carton is folded out, the bottom flaps, sandwiched between the side wall panels as shown in FIG. 6 unfold downwardly. The fastening arrangement of section 230 to flap 152 ensures that major flap 152 and minor flap 160 move synchronously when the carton is unfolded and that major flap 152 overlies minor flap 160 when the carton is in its expanded position. Correspondingly, the fastening arrangement of section 228 to flap 150 ensures that major flap 150 and minor flap 158 move at the same time when the carton is unfolded and that major flap 150 overlies minor flap 158 when the carton is in its expanded position. Further, the cut-away portion, i.e, the angled shape of triangular section 222, provides clearance for the minor flap 160 to pass by major flap 150 as the carton is folded out into its expanded position. Major flap 150 thus overlies minor flap 160 in the expanded position of the carton. Correspondingly, the angled shape of triangular section 220 provides clearance for the minor flap 158 to pass by major flap 152 as the carton is folded out from the collapsed to its expanded position. Major flap 152 thus overlies minor flap 158 in the expanded position of the carton. In the expanded position of the carton bisector foldlines 216, 218 extend from diametrical corners 258, 260 of the carton, and tab 168 overlies triangular section 220 of minor flap 158 while tab 166 overlies triangular section 222 of minor flap 160. In the flat blank, foldlines 216, 218 are parallel to each other and form an angle of about 45° with panel-flap foldlines 212, 214 respectively. Triangular section 220 of minor flap 158 is defined between bisector foldline 216, panel-flap foldline 212 and diagonal edge 262 connecting the bisector foldline and the panel-flap foldline. Correspondingly, triangular section 222 of minor flap 160 is defined between bisector foldline 218, panel-flap foldline 214 and diagonal edge 264.

As the carton is brought into its expanded position such that side wall panels 154, 162 are opposed to panels 156, 164 respectively, divider panels 196, and the divider panel including divider panel portions 200, 206 are folded further inwardly along panel foldlines 176, 202 such that partitions 266, 268, 270, 272 move into place to intersect above a center point of the carton bottom by virtue of the adhesive connection of tabs 242, 244 to regions 238, 240 and tabs 250, 252 to scored region 248. Partition 266 is thus defined between panel foldline 202, upper foldline 192 and cutline 274. Partition 268 is defined between panel foldline 202, upper foldline 182 and cutline 204. Partition 270 is defined between upper foldline 190, panel foldline 176 and cutline 198. Partition 272 is defined between upper foldline 184, panel foldline, panel foldline 176 and cutline 198.

Divider panels 180, 188 are additionally required to be folded inwardly from the side wall panels, by compression along panel foldlines 174, 178 to form partition reinforcement panels 276, 278, 280 and 282. Partition reinforcement panel 276 is thus defined between upper foldline 192, panel foldline 174 and cutline 194. Partition reinforcement panel 278 is defined between panel foldline 174, upper foldline 190 and cutline 194. Partition reinforcement panel 280 is defined between upper foldline 184, panel foldline 178 and cutline 186. Partition reinforcement panel 282 is defined between panel foldline 178, upper foldline 182 and cutline 186.

In the fully expanded position registering ports defined by edges 286 register to form a central handle as seen in FIGS. 3 and 4. Perforations 288 on panel foldline 176 above cutline 198, panel foldline 174 between cutline 194 and edge 286, and panel foldline 178 between cutline 186 and edge 286 assist in obtaining a clean fold of the upper portions above said centerpoint of the carton. Clean inward folding of divider panels 180, 188 is further facilitated by rounded ends 284 of the cutlines.

Cutlines 186, 194 connect upper foldlines 182, 184 and upper foldlines 190, 192 respectively. Cutline 198 joins upper foldlines 184, 190 while once the carton is assembled cutlines 204, 274 form a single cutline which joins upper foldlines 182, 192. Cutline 186 is vertically spaced apart at its ends from cutlines 198, 204 such that webs 290 hold partitions and reinforcement panels to the panel side walls. Correspondingly, ends of cutline 198 are vertically spaced apart from ends of cutlines 186, 194, ends of cutline 194 are vertically spaced apart from ends of cutlines 274, 198 and ends of the cutline including cutlines 204, 274 of the assembled carton are vertically spaced apart from ends of cutline 186, 194. It will be appreciated that as the height of each web 290 is increased so is its strength against shear when the carton is held by the handle provided the registering ports.

The arrangement of the floor flaps is such that the carton is resistant to collapse. In its expanded position the minor floor flaps are generally parallel to each other. When upward or downward forces are exerted on the floor to move the minor floor flaps out of their parallel position and edges 170, 172 are drawn towards each other to be brought into abutting contact, there is resistance to further movement of the minor flaps with respect to each other and so too the major flaps to which they are glued. Tabs 166, 168 with edges 170, 172 which so abut are thus said to interlock. The minor flaps, by resisting movement from their parallel position and by virtue of their attachment to the major flaps, all floor flaps being attached to the side wall panels, tend to hold the carton in its expanded position. Edges 170, 172 are parallel to panel-flap foldlines 212, 214 when the carton is in its expanded position, as can be seen in FIG. 5. Edge 292, is located on a line which extends from and bisects the right angle defined between edge 262 and bisector foldline 216. Correspondingly, edge 294 is located on a line which extends from and bisects the right angle defined between edge 264 and bisector foldline 218. Inward compression of side wall panels 154, 156 brings edges 292, 294 into abutting contact which abutment augments the resistance of the expanded carton to collapse.

In the illustrated embodiment, minor flap 158 is glued to major flap 150 while minor flap 160 is glued to major flap 152. Major flap 152 is smaller than major flap 150, i.e., major flap 150 extends further from the side panel to which it is attached. This arrangement is such that clearance is provided for the smaller flap past the larger flap as the carton unfolds from its collapsed to its expanded position. Major flap 150 thus overlies major flap 152 in the expanded position of the carton, at least to the extent that the two flaps overlap.

Scored region 246 on the proximal end of the obverse face of major flap 150 has glue applied to it for attachment to section 228 of neighboring minor flap 158. The distal end 296 of flap 150 to which glue is not applied is divided from the proximal end by foldline 298. Section 228 in the area of tab 166 is thus free from glue and, the distance $d_1$ being less than the distance $d_2$, tab 166 has clearance to pass by major flap 152 as the carton is unfolded from its collapsed to its open position. This arrangement thus ensures that the carton folds out into an expanded position in which tab 166 underlies major flap 152. The distance $d_3$ is less than the distance $d_1$ and with the gluing arrangement shown, tab 168 has clearance to pass by tab 166 and tab 166 thus overlies tab 168 as the tabs come into contact. As the carton is unfolded further towards its expanded position edge 300 of tab 168 is guided into contact with edge 292 of minor flap 158 and the rounded portion 302 of edge 300 facilitates the movement of tab 168 as it finally snaps into the position shown in FIG. 5. It will be appreciated that as the lengths of edges 292, 294 are increased, that is, as the distances between edges 170, 172 and panel-flap foldlines 212, 214 respectively are increased, the ease with which the carton unfolds from its collapsed to expanded position increases. On the other hand such a geometrical change would space edges 170, 172 further apart from each other when the carton is in its expanded position. Consequently forces, such as downward forces on the floor of the expanded carton, which draw edges 170, 172 together would tend to deform the shape of the carton to a greater extent before abutment of edges 170, 172 occured. Such a geometrical change would thus lead to a carton which unfolds into its expanded position more readily but which would be less resistant to deformation once in its expanded position.

The assembled carton may be stored and shipped in its collapsed position and folded out to expanded position just prior to use. The carton may be folded out and packed with, for example, four beverage bottles using automated equipment. The illustrated embodiment is dimensioned to receive four 296 ml beverage bottles and is of a 020 gauge resinous paperboard material known as Carrier Kote available from Mead Corporation but may be made from any suitably flexible and strong material.

It will be understood that the preferred embodiment illustrates the invention disclosed herein, but is not intended to limit the scope of protection sought. There are many possible variations to the invention, in the size, shape, etc. of a blank or box or elements thereof which a skilled person would be able to make while remaining within the scope of the invention as defined by the appended claims.

What is claimed is:

1. A carton having a collapsed position and expanded position and formed from a single blank having an obverse face, outwardly directed when the carton is in the expanded position and a reverse face, which carton comprises:

(i) four side wall panels, first and second pairs of which are opposed when the carton is in the expanded position, adjacent panels being attached along panel foldlines;

(ii) a pair of major bottom flaps, each major flap foldably attached to a panel of one or the other of the pairs of side wall panels;

(iii) a pair of minor bottom flaps, each minor flap foldably attached to a panel of the other of the pairs of side wall panels; wherein:

(iv) each minor flap has a foldline extending from and bisecting one corner of a pair of diametrical corners of the carton when in the expanded position to divide the flap into a first section adjacent the panel to which the flap is attached and a second section neighboring a said major flap;

(v) the reverse face of each of the second sections is fastened to the obverse face of the neighboring major flap such that when in the expanded position each second section underlies the flap to which it is fastened and when in the collapsed position, the carton is folded along first and second of the panel foldlines and the bottom flaps are sandwiched between the side wall panels;

(vi) each of the second sections includes a tab located to overlap the other of the second sections when the carton is in the expanded position and each of the tabs has an edge, which edges are located to interlock with each other when the carton is in the expanded position to resist collapse of the carton from the expanded to the collapsed position;

(vii) the major flaps overlap each other when the carton is in the expanded position and the major flaps are sized differently from each other to prevent bridging of the major flaps when the carton is folded out from the collapsed to the expanded position; and (viii) the first sections are shaped to provide clearance for the minor flaps past the major flaps as the carton is folded out from the collapsed to the expanded position so that the major flaps overlie the minor flaps when the carton is in the expanded position, and so that the first and second tabs overlie the second and first minor flaps respectively when the carton is in the expanded position.

2. The carton of claim 1 wherein:

(a) each side wall panel includes an upper foldline, which upper foldline is midway between, and parallel to, the panel foldlines; and (b) a cutline extends between each adjacent pair of upper foldlines across the panel foldline between each pair, dividing the panel foldline into an upper portion above the cutline and a lower portion below the cutline, the end of each cutline being vertically spaced apart from its adjacent cutlines by a web, such that, when the carton is folded out from the collapsed to the expanded position inward compression on the upper portion of the panel foldlines toward the centre of the carton forms a partition above each cutline, dividing the carton into four compartments.

3. The carton of claim 2 in which ports are provided above each cutline, which ports register to provide an aperture for hand holding the carton when the carton is folded to the expanded position and the partitions are formed.

4. The carton of claims, 1, 2 or 3 in which the panels are of equal size, so that the carton bottom is square when the carton is in the expanded position.

5. The carton of claims 1, 2 or 3 in which the panels are of equal size, and the panel foldlines and the foldline between the flaps and the panels meet at right angles so that the carton bottom is square and the wall panels perpendicular to the bottom when the carton is in the expanded position.

6. A blank for a carton as claimed in claim 5.

7. A paperboard carton as claimed in claim 5.

8. A blank for a carton as claimed in claim 1.

* * * * *